US006746998B2

(12) United States Patent
Fitzgerald

(10) Patent No.: US 6,746,998 B2
(45) Date of Patent: Jun. 8, 2004

(54) NON-FLAMMABLE TERNARY CLEANING SOLVENT

(75) Inventor: James M. Fitzgerald, Atlanta, GA (US)

(73) Assignee: Illinois Tool Works, Inc., Glenview, IL (US)

( * ) Notice: Subject to any disclaimer, the term of this patent is extended or adjusted under 35 U.S.C. 154(b) by 64 days.

(21) Appl. No.: 10/153,973

(22) Filed: May 23, 2002

(65) Prior Publication Data

US 2003/0220218 A1 Nov. 27, 2003

(51) Int. Cl.[7] ..... C11D 7/50
(52) U.S. Cl. ..... 510/410; 510/177; 510/408
(58) Field of Search ..... 252/364, 67; 521/131, 521/198; 510/177, 411, 410, 408, 412, 365, 175; 134/40, 38

(56) References Cited

U.S. PATENT DOCUMENTS 5,116,525 A * 5/1992 Merchant ..... 252/67
5,126,067 A * 6/1992 Swan et al. ..... 510/408
5,348,681 A * 9/1994 Desbiendras et al. ..... 510/177
5,478,492 A * 12/1995 Barthelemy et al. ..... 510/177
5,851,977 A * 12/1998 Gorton et al. ..... 510/412
2003/0050356 A1 * 3/2003 Bogdan et al.

FOREIGN PATENT DOCUMENTS

JP 02204451 A * 8/1990
JP 02207033 A * 8/1990

* cited by examiner

*Primary Examiner*—Gregory Webb
(74) *Attorney, Agent, or Firm*—Mark W. Croll, Esq.; Donald J. Breh, Esq.; Welsh & Katz, Ltd.

(57) ABSTRACT

A non-flammable ternary liquid cleaner is formulated from first, second and third solvents. The first solvent is a hydrofluorocarbon, the second solvent is a dichloroethylene and the third solvent is a hydrochlorofluorocarbon. The hydrochlorofluorocarbon imparts low flammability to the cleaner. The hydrofluorocarbon is present in a concentration of about 10 percent to about 80 percent by weight of the cleaner, the dichloroethylene is present in a concentration of about 10 percent to about 60 percent by weight of the cleaner and the hydrochlorofluorocarbon is present in a concentration of at about 10 percent to about 40 percent by weight of the cleaner. The third solvent is non-flammable and thus renders the ternary cleaner non-flammable.

19 Claims, No Drawings

NON-FLAMMABLE TERNARY CLEANING SOLVENT

BACKGROUND OF THE INVENTION

The present invention pertains to a cleaner. More specifically, the present invention pertains to a non-flammable ternary cleaning solvent for use in precision cleaning applications.

Cleaning solvents or cleaners are used during the manufacture and rework of electronic, telecommunications and other electrical equipment to clean the components prior to final assembly. These cleaners are also used during maintenance operations carried out on electrical equipment in order to provide for proper electrical conductivity where two conductive (e.g., metal) surfaces are to be joined to one another in electrical contact.

For example, these cleaners are used during the manufacture, maintenance, repair and assembly of printed circuit boards, connectors, relays and contacts, solenoids, motors and motor windings, circuit breakers, circuit breaker panels, transformers, electrical and data communication connectors and switching devices, electronic controls, timers, cable assemblies, splices and terminations, hydraulic and pneumatic equipment, magnetic read/write equipment, optical equipment and the like.

Typically, these cleaners are used to remove contaminants, and more particularly, flux, grease, light oils, corrosive contaminants, oxidation products and the like prior to a final assembly or during or after equipment and component maintenance.

Many such cleaners are provided in aerosol form. These aerosol cleaners include a solvent and a propellant. Many aerosol formulations contain constituents that render the formulation relatively flammable. That is, the solvents, in and of them selves (without the propellant) are relatively flammable. This can be problematic in a manufacturing facility, as during fabrication or in a workplace when performing equipment and component maintenance. Moreover, many of these aggressive solvents cannot be used with certain types of plastics due to their aggressive nature. Nevertheless, because of the strong or aggressive cleaning characteristics of these formulations, for many applications their use continues.

Other formulations are known that exhibit lower flammability tendencies. However, these formulations typically do not have sufficiently aggressive cleaning characteristics, and as such are not of great import or use. Moreover many of the aforementioned cleaners (solvents) are not dual application use. That is, many of these formulations can be used either as a liquid or as an aerosol, but not necessarily as both.

Accordingly, there exists a need for a cleaning solvent having good cleaning characteristics, as well as low flammability. Desirably, such a solvent has low or no ozone depletion potential and a high degree of plastic compatibility. More desirably, such a cleaner is formulated so that it can be used as a liquid or, with the proper propellant, as an aerosol.

BRIEF SUMMARY OF THE INVENTION

A nonflammable ternary liquid cleaner is formulated from first, second and third solvents. The first solvent is a hydrofluorocarbon, the second solvent is a dichloroethylene and the third solvent is a hydrochlorofluorocarbon. The hydrochlorofluorocarbon imparts low flammability to the cleaner.

The first solvent, hydrofluorocarbon, is present in a concentration of at about 10 percent to about 80 percent by weight of the cleaner, the second solvent, the dichloroethylene, is present in a concentration of about 10 percent to about 60 percent by weight of the cleaner and the third solvent, the hydrochlorofluorocarbon is present in a concentration of at about 10 percent to about 40 percent by weight of the cleaner. The cleaner exhibits low to no residual flammability.

In a present formulation, the first solvent is 1,1,1,3,3-pentafluorobutane, the second solvent is trans-1,2-dichloroethylene and the third solvent is 3,3-dichloro-1,1,1,2,2-pentafluoropropane and/or 1,3-dichloro-1,1,2,2,3-pentafluoropropane. In the present formulation, the third solvent is present in a concentration of about 12 percent to about 15 percent.

The cleaner can be used as a liquid. Alternately, the cleaner can be formulated as an aerosol and includes a propellant. A preferred propellant is present in a concentration of less than about 5 percent to about 30 percent of a total weight of the cleaner and the propellant. A preferred propellant is an HFC liquefied gas, such as tetrafluoroethane. A most preferred tetrafluoroethane is 1,1,1,2-tetrafluoroethane.

Other features and advantages of the present invention will be apparent from the following detailed description, in conjunction with the appended claims.

DETAILED DESCRIPTION OF THE INVENTION

While the present invention is susceptible of embodiment in various forms, there is hereinafter described a presently preferred embodiment with the understanding that the present disclosure is to be considered an exemplification of the invention and is not intended to limit the invention to the specific embodiment described. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

A nonflammable ternary cleaner is formulated from a combination of first, second and third solvents. The first solvent is a hydrofluorocarbon, preferably 1,1,1,3,3-pentafluorobutane. The second solvent is a dichloroethylene, preferably trans-1,2-dichloroethylene. The third solvent is a hydrochlorofluorocarbon, preferably 3,3-dichloro-1,1,1,2,2-pentafluoropropane and/or 1,3-dichloro-1,1,2,2,3-pentafluoropropane. The third solvent has a low flammability, and as such, imparts a low flammability to the cleaner overall.

In a present formulation, the first solvent is present in a concentration of at about 10 percent to about 80 percent by weight of the cleaner, the second solvent is present in a concentration of about 10 percent to about 60 percent by weight of the cleaner and the third solvent is present in a concentration of at about 10 percent to about 40 percent by weight of the cleaner.

The cleaner can be formulated for use as a liquid, e.g., direct application, or it can be formulated for use as an aerosol. In one aerosol formulation, the propellant is a hydrofluorocarbon (HFC) liquefied gas. Preferably, the IFC liquefied gas is 1,1,1,2 tetrafluoroethane, present in a concentration of about less than 5 percent to about 50 percent by weight of the total weight of the cleaner and the propellant. In a present formulation, the propellant is present in a concentration of about less than 5 percent to about 30 percent of a total weight of the cleaner and the propellant, and most preferably about 25 percent of the total weight of the cleaner and the propellant. However, in order to reduce the "freezing" effect that may be exhibited by aerosol cleaners, the propellant concentration may be reduced to less than or about 5 percent. In such cases, carbon dioxide may also be used to assist the hydrocarbon propellant.

It has been found that a ternary cleaner in accordance with the present invention can be used in a wide variety of applications. For example, the present cleaner can be used for cleaning electrical components including printed circuit boards, connectors, relays and contacts, solenoids, motors and motor windings, circuit breakers, circuit breaker panels, transformers, electrical and data communication connectors and switching devices, electronic controls, timers, cable assemblies, splices and terminations, hydraulic and pneumatic equipment, magnetic equipment, fiber optics and the like.

It has been observed that the present cleaner, which provides a range of concentrations of the various solvents, can be formulated having varying degrees of aggressiveness, while at the same time, maintaining non-flammable characteristics. Those skilled in the art will appreciate that the first solvent, namely the hydrofluorocarbon, exhibits relatively good solvent properties, but generally lacks aggressiveness. This provides application in that it precludes or limits the degradation of plastics and other polymerics, such as that which may be used as substrates in the manufacture of printed circuit boards and components.

The second solvent, namely the dichloroethylene, on the other hand exhibits strongly aggressive solvent properties. As such, it has been found that although the dichloroethylene could, in sufficiently high concentrations adversely effect the integrity of certain plastics and polymers, when used in combination with the selected hydrofluorocarbon, the aggressive tendencies of the solvent are tempered and the solvent as formulated is acceptable for use in essentially all of the electrical, electromechanical and mechanical applications as noted above.

As will be appreciated by those skilled in the art, is that both the hydrofluorocarbon (e.g., the 1,1,1,3,3-pentafluorobutane) and the dichloroethylene (e.g., the trans-1,2-dichloroethylene) are flammable. As such, one drawback of this binary combination is that the combination of these constituents creates an otherwise flammable mixture that is not likely recommended for use with "live" electrical equipment.

It has, however been found that the use of the third solvent, namely the hydrochlorofluorocarbon (e.g., 3,3-dichloro-1,1,1,2,2-pentafluoropropane and/or 1,3-dichloro-1,1,2,2,3-pentafluoropropane) provides additional solvent characteristics while at the same time reducing the overall flammability of the cleaner, such that the cleaner is non-flammable. As such, it has been found that the unique combination of solvents provides a cleaner formulation in which the aggressiveness of the cleaner can be varied to suit a desired application and that has a reduced flammability permitting use on "live" electrical equipment.

Although the third solvent does, in fact, exhibit solvent characteristics, it is less aggressive than the first and second solvents. Nevertheless, it adds the benefit of reducing the flammability of the solvent overall. To this end, evaluations were made to determine the concentration of the third solvent that is necessary to provide total flame suppression.

It was found that using only the first solvent, that is the hydrofluorocarbon, it was found that a minimum concentration of hydrochlorofluorocarbon of 15 percent was required. That is, a formulation of 85 percent hydrofluorocarbon and 15 percent hydrochlorofluorocarbon resulted in complete or total flame suppression. When using the second solvent, that is, the dichloroethylene, it was found that a minimum concentration of 12 percent hydrochlorofluorocarbon was required. That is, a formulation of 88 percent dichloroethylene and 12 percent hydrochlorofluorocarbon resulted in complete flame suppression. It has also been found that a formulation of 43 percent of the first solvent (hydrofluorocarbon) and 43 percent of the second solvent (dichloroethylene) required 15 percent of the third solvent (hydrochlorofluorocarbon) for total flame suppression. It is anticipated that this relation is linear, and that varying the concentrations of the first and second solvents (between zero percent and 100 percent relative to one another) will result in minimum concentrations of the third solvent required for complete flame suppression between 12 percent and 14 percent.

In a present ternary cleaner, the first solvent that is used, namely, the hydrofluorocarbon is 1,1,1,3,3-pentafluorobutane, commercially available under the trade name Solkane® 365mfc, from Solvay Fluorides, Inc, of Saint Louis, Mo. The second solvent, namely the dichloroethylene used is trans-1,2-dichloroethylene, commercially available from PPG Industries, Inc, of Pittsburgh, Pa. The third solvent, namely 3,3-dichloro-1,1,1,2,2-pentafluoropropane and/or 1,3-dichloro-1,1,2,2,3-pentafluoropropane are commercially available under the trade name Asahiklin AK-225, from Asahi Glass Co., Ltd., of Japan As set forth above, the present cleaner can be used in liquid form and can also be provided as an aerosol. When provided in aerosol form, a preferred propellant for use in the cleaner is an HFC liquefied gas. Most preferably, the propellant is a tetrafluoroethane (HFC-134a). When used as a propellant, the HFC-134a is present in a concentration of less than about 5 percent to about 50 percent by weight of the total weight of the cleaner and the propellant. In a present formulation, the propellant is present in a concentration of about less than 5 percent to about 30 percent of a total weight of the cleaner and the propellant, and most preferably about 25 percent of the total weight of the cleaner and the propellant. In that the propellant can produce a freezing effect, it may be desirable for a particular application to maintain the propellant concentration as low as is reasonably achievable, less than about 5 percent, in which case, carbon dioxide may be used to assist the hydrocarbon propellant.

Various samples of non-flammable ternary cleaner were made, in aerosol form, and evaluated for their cleaning properties. In one formulation, Number 99A, the first solvent was present in a concentration of 19.7 percent, the second solvent was present in a concentration of 42.2 percent and the third solvent was present in a concentration of 10.2 percent. In this formulation, the propellant was present in a concentration of 25 percent and included carbon dioxide at a concentration of 2.0 percent. The cleaner also included a trace amount of methanol at 0.9 percent. The concentration of the first, second and third solvents, without the propellant was 27.0 percent, 57.8 percent and 14.0 percent, respectively.

In a second formulation of the cleaner, Number 98A, the first solvent was present in a concentration of 28.4 percent, the second solvent was present in a concentration of 35.2 percent and the third solvent was present in a concentration of 10.5 percent. In this formulation, the propellant was present in a concentration of 25 percent. The cleaner also included a trace amount of methanol at 0.9 percent. The concentration of the first, second and third solvents, without the propellant was 37.9 percent, 46.9 percent and 14.0 percent, respectively.

In a third formulation of the cleaner, Number 100A, the first solvent was present in a concentration of 24.2 percent, the second solvent was present in a concentration of 47.2 percent and the third solvent was present in a concentration of 11.6 percent. In this formulation, the propellant was present in a concentration of 15 percent and included carbon dioxide at a concentration of 2.0 percent. The concentration of the first, second and third solvents, without the propellant was 29.2 percent, 56.8 percent and 14.0 percent, respectively.

In a fourth formulation of the cleaner, Number 97A, the first solvent was present in a concentration of 42.9 percent, the second solvent was present in a concentration of 12.3 percent and the third solvent was present in a concentration of 34.8 percent. In this formulation, the propellant was present in a concentration of 5.0 percent and included carbon dioxide at a concentration of 2.0 percent. This formulation further included isohexane at a concentration of 2.9 percent and nitroethane at a concentration of 0.1 percent. It was found that the isohexane enhanced the cleaning characteristics of the cleaner and the nitroethane inhibited reaction among and between the various constituents of the cleaner. The concentration of the first, second and third solvents, without the propellant (including the carbon dioxide), the isohexane and the nitroethane was 46.1 percent, 13.2 percent and 37.4 percent, respectively.

It was found that each of these formulations functioned well as a solvent, while avoiding the overly aggressive tendencies that would otherwise be detrimental to polymer substrates and the like, and still provided total flammability suppression.

One measure of the solvency of a hydrocarbon is referred to as the kauri-butanol or KB value. A higher KB value signifies a greater hydrocarbon solvency. American Society of Testing and Materials (ASTM) standard D 1133 provides a method for determining the KB value of a hydrocarbon.

In this method, a hydrocarbon sample is added to a standard solution of kauri gum in butyl alcohol (butanol) until sufficient kauri gum precipitates to blur vision of 10-point type viewed through a flask. When used in varnish, lacquer and enamel formulations, a hydrocarbon diluent with a high KB value dissolves relatively large quantities of solids.

In preparing the various non-flammable ternary formulations discussed above, it was first noted that the KB values of the first and second solvents, the hydrofluorocarbon and the dichloroethylene have KB values of 14 and 117, respectively. It was contemplated that blended proportions could be made that would produce a broad range of solvency and plastics compatibility. However, since each of these materials is flammable, all binary blends would exhibit some degree of flammability.

It was thus contemplated that the flammability could be mitigated with materials such as methoxy-nonafluorobutane (HFE-7100) having a KB of 10 and decafluoropentane (Vertrel) having a KB of 9, but relatively that large amounts would be required. This would result in significant diminution of solvency.

It was subsequently found that blends of the first and second solvents, namely, 1,1,1,3,3-pentafluorobutane and trans-1,2-dichloroethylene, could be rendered nonflammable with relatively small amounts of a third solvent, namely, 3,3-dichloro-1,1,1,2,2-pentafluoropropane and/or 1,3-dichloro-1,1,2,2,3-pentafluoropropane resulting in a much broader and more useful solvency range. It was found that concentrations of 3,3-dichloro-1,1,1,2,2-pentafluoropropane and/or 1,3-dichloro-1,1,2,2,3-pentafluoropropane as low as about 12 percent to about 15 percent could render the combined other solvents non-flammable. This even with the third solvent, that 3,3-dichloro-1,1,1,2,2-pentafluoropropane and/or 1,3-dichloro-1,1,2,2,3-pentafluoropropane having a KB value of about 31. Thus, not only is the present cleaner non-flammable, but it also provides a relatively high KB value (and thus good solvency), in a variety of formulations that can be made to and for a desired application.

Various formulations, as discussed above, were prepared and their KB values determined in accordance with ASTM D1133. The minimum KB value, corresponding to a blend of 86 percent of the first solvent and 14 percent of the third solvent was found to be 11.5. The maximum KB value, corresponding to a blend of 86 percent of the second solvent and 14 percent of the third solvent was found to be 86.9. Both of these blends were found to be non-flammable.

A number of intermediate ternary blends (as presented above) were also prepared and evaluated. One blend (Number 98A) included 39 percent of the first solvent, 47 percent of the second solvent and 14 percent of the third solvent. This blend or formulation was found to have a KB value of 40 and served as a good general-purpose cleaner/degreaser.

Another intermediate ternary blend or formulation (Number 99A) included 27 percent of the first solvent, 59 percent of the second solvent and 14 percent of the third solvent. This blend had a KB value of 56 and was found to be a quite aggressive flux remover.

Other advantages were found with the present non-flammable ternary cleaner. First, because no ozone depletion potential (ODP) is associated with either the first or second solvents, and only a low ODP is associated with the third solvent (an ODP of about 0.03), and further because the concentration of the third solvent can be limited to that amount needed for flame suppression, the ODP of the overall composition is effectively minimized.

In addition, both the first and third solvents are presently exempt from Federal Volatile Organic Compounds (VOC) regulations, and at present, an exemption is pending for the second solvent. Thus, further limiting any adverse environmental impact that the present solvent may have.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A non-flammable liquid cleaner, comprising:

a first solvent being 1,1,1,3,3-pentafluorobutane;

a second solvent being a dichloroethylene;

a third solvent being a hydrochlorofluorocalbon having low flammability, wherein the 1,1,1,3,3-pentafluorobutane is present in a concentration of at about 10 percent to about 80 percent by weight of the cleaner, the second solvent is present in a concentration of about 10 percent to about 60 percent by weight of the cleaner and the third solvent is present in a concentration of at about 10 percent to about 40 percent by weight of the cleaner, and wherein the cleaner is non-flammable.

2. The cleaner in accordance with claim 1 wherein the second solvent is trans-1,2-dichloroethylene.

3. The cleaner In accordance with claim 1 wherein the third solvent is 3,3-dichloro-1,1,1,2,2-pentafluoropropane and/or 1,3-dichloro-1,1,2,2,3-pentafluoropropane.

4. The cleaner in accordance with claim 3 wherein the third solvent is present in a concentration of about 12 percent to about 40 percent.

5. The cleaner in accordance with claim 3 wherein the third solvent is present in a concentration of about 12 percent to about 15 percent.

6. The cleaner in accordance with claim 4 wherein the third solvent is present in a concentration about 30 percent to about 40 percent.

7. The cleaner in accordance with claim 1 wherein the cleaner is formulated as an aerosol and includes a propellant.

8. The cleaner in accordance with claim 7 wherein the propellant is present is in a concentration of about less than 5 percent to about 30 percent of a total weight of the cleaner and the propellant.

9. The cleaner in accordance with claim 8 wherein the propellant is an HFC liquefied gas.

10. The cleaner in accordance with claim 9 wherein the HFC liquefied gas is tetrafluoroethane.

11. The cleaner in accordance with claim 10 wherein the tetrafluoroethane is 1,1,1,2-tetrafluoroethane.

12. A non-flammable liquid cleaner, comprising:

a first solvent being a hydrofluorocarbon;

a second solvent being a dichloroethylene;

a third solvent being 3,3-dichloro-1,1,1,2,2-pentafluoropropane and/or 1,3-dichloro-1,1,2,2,3-pentafluoropropane, and having low flammability, wherein the first solvent is present in a concentration of at about 10 percent to about 80 percent by weight of the cleaner, the second solvent is present in a concentration of about 10 percent to about 60 percent by weight of the cleaner and the third solvent is present in a concentration of at about 10 percent to about 40 percent by weight of the cleaner, and wherein the cleaner is non-flammable.

13. The cleaner in accordance with claim 12 wherein the first solvent is 1,1,1,3,3-pentafluorobutane.

14. The cleaner in accordance with claim 12 wherein the second solvent is trans-1,2-dichloroethytene.

15. The cleaner in accordance with claim 12 wherein the third solvent is present in a concentration of about 12 percent to about 40 percent.

16. The cleaner in accordance with claim 12 wherein the cleaner is formulated as an aerosol and includes a propellant.

17. The cleaner in accordance with claim 16 wherein the propellant is present in a concentration of about less than 5 percent to about 30 percent of a total weight of the cleaner and the propellant.

18. The cleaner in accordance with claim 17 wherein the propellant is an HFC liquefied gas.

19. The cleaner in accordance with claim 18 wherein the HFC liquefied gas is tetrafluoroethane.

* * * * *

US006746998C1

(12) EX PARTE REEXAMINATION CERTIFICATE (9524th)

United States Patent

Fitzgerald

(10) Number: US 6,746,998 C1

(45) Certificate Issued: Feb. 22, 2013

(54) NON-FLAMMABLE TERNARY CLEANING SOLVENT

(75) Inventor: James M. Fitzgerald, Atlanta, GA (US)

(73) Assignee: Illinois Tool Works Inc., Glenview, IL (US)

Reexamination Request:
No. 90/012,477, Sep. 7, 2012

Reexamination Certificate for:

| | |
|---|---|
| Patent No.: | **6,746,998** |
| Issued: | **Jun. 8, 2004** |
| Appl. No.: | **10/153,973** |
| Filed: | **May 23, 2002** |

(51) Int. Cl.

| | |
|---|---|
| ***C11D 7/5081*** | (2006.01) |
| ***C11D 7/28*** | (2006.01) |
| ***C11D 7/261*** | (2006.01) |
| ***C11D 7/5018*** | (2006.01) |
| ***C11D 7/5063*** | (2006.01) |

(52) U.S. Cl. ..... 510/410; 510/177; 510/408

(58) Field of Classification Search ..... None
See application file for complete search history.

(56) References Cited

To view the complete listing of prior art documents cited during the proceeding for Reexamination Control Number 90/012,477, please refer to the USPTO's public Patent Application Information Retrieval (PAIR) system under the Display References tab.

*Primary Examiner* — Dwayne Jones

(57) ABSTRACT

A non-flammable ternary liquid cleaner is formulated from first, second and third solvents. The first solvent is a hydrofluorocarbon, the second solvent is dichloroethylene and the third solvent is a hydrochlorofluorocarbon. The hydrochlorofluorocarbon imparts low flammability to the cleaner. The hydrochlorofluorocarbon is present in a concentration of about 10 percent to about 80 percent by weight of the cleaner, the dichloroethylene is present in a concentration of about 10 percent to about 60 percent by weight of the cleaner and the hydrochlorofluorocarbon is present in a concentration of about 10 percent to about 40 percent by weight of the cleaner. The third solvent is non-flammable and thus readers the ternary cleaner non-flammable.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4 and 13 are cancelled.

Claims 1, 5, 6, 12 and 14 are determined to be patentable as amended.

Claims 2, 7-11 and 15-19, dependent on an amended claim, are determined to be patentable.

1. A non-flammable liquid cleaner, comprising:

a first solvent being 1,1,1,3,3-pentafluorobutane;

a second solvent being a dichloroethylene;

a third solvent being a [hydrochlorofluorocalbon] *hydrochlorofluorocarbon* having low flammability, wherein the 1,1,1,3,3-pentafluorobutane is present in a concentration of at about 10 percent to about 80 percent by weight of the cleaner, the second solvent is present in a concentration of about 10 percent to about 60 percent by weight of the cleaner and the third solvent is present in a concentration of at about 10 percent to about 40 percent by weight of the cleaner, and wherein the cleaner is non-flammable.

5. The cleaner in accordance with claim [3] *1* wherein the third solvent is present in a concentration of about 12 percent to about 15 percent.

6. The cleaner in accordance with claim [4] *1* wherein the third solvent is present in a concentration about 30 percent to about 40 percent.

12. A non-flammable liquid cleaner, comprising:

a first solvent being [a hydrofluorocarbon] *1,1,1,3,3-pentafluorobutane*;

a second solvent being a dichloroethylene;

a third solvent being 3,3-dichloro-1,1,1,2,2-pentafluoropropane and/or 1,3-dichloro-1,1,2,2,3-pentafluoropropane, and having low flammability, wherein the first solvent is present in a concentration of at about 10 percent to about 80 percent by weight of the cleaner, the second solvent is present in a concentration of about 10 percent to about 60 percent by weight of the cleaner and the third solvent is present in a concentration of at about 10 percent to about 40 percent by weight of the cleaner, and wherein the cleaner is non-flammable.

14. The cleaner in accordance with claim 12 wherein the second solvent is [trans-1,2-dichloroethytene] *trans-1,2-dichloroethylene*.

* * * * *